US007308940B2

(12) United States Patent
Vuyk et al.

(10) Patent No.: US 7,308,940 B2
(45) Date of Patent: Dec. 18, 2007

(54) FLEXIBLE WELLBORE BROACH

(75) Inventors: Adrian Vuyk, Houston, TX (US); Michael Sullivan, Katy, TX (US); Gene Halford, Rosharon, TX (US); Robert Finch, The Woodlands, TX (US); Mark Schnitker, Friendswood, TX (US); Jerry Fisher, Tomball, TX (US); Ken Winterrowd, Pearland, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 251 days.

(21) Appl. No.: 11/037,793

(22) Filed: Jan. 18, 2005

(65) Prior Publication Data

US 2005/0155766 A1 Jul. 21, 2005

Related U.S. Application Data

(60) Provisional application No. 60/536,946, filed on Jan. 16, 2004.

(51) Int. Cl.
*E21B 29/10* (2006.01)

(52) U.S. Cl. ..... 166/298; 166/55.7

(58) Field of Classification Search ..... 166/298, 166/55.7, 55.1, 55.6, 242.2, 242.6
See application file for complete search history.

(56) References Cited

U.S. PATENT DOCUMENTS 2,716,542 A * 8/1955 Goble ..... 464/19
5,109,924 A 5/1992 Jurgens et al.
5,148,877 A 9/1992 MacGregor
5,657,820 A 8/1997 Bailey et al.
6,155,349 A 12/2000 Robertson et al.
6,668,945 B2 * 12/2003 Ohmer ..... 175/61

OTHER PUBLICATIONS

U.K. Search Report, Application No. GB0500651.5, dated Mar. 14, 2005.

CA Office Action, Application No. 2,492,626, Dated Sep. 15, 2006.

* cited by examiner

*Primary Examiner*—David Bagnell
*Assistant Examiner*—Daniel P Stephenson
(74) *Attorney, Agent, or Firm*—Patterson & Sheridan, LLP

(57) ABSTRACT

A method and apparatus for milling and/or broaching within a wellbore. A flexible broach runs into the wellbore and is located adjacent a portion of the wellbore to be broached. The broach reciprocates axially within the wellbore and removes at least part of the portion to be broached. Weight may be coupled to the broach, thereby applying a resultant side load for broaching an offset portion of the wellbore. The broach comprises a flexible member that may be a bare cable. When an abrasive material is disposed on an outer surface of the flexible member, the flexible member may be a cable, a continuous rod, or pressurized coiled tubing. Alternatively, sleeves positioned on the flexible member may have an abrasive material on their outer surface. A rotational mill that is either coupled to the broach or run in separately from the broach can further mill the wellbore.

36 Claims, 6 Drawing Sheets

FLEXIBLE WELLBORE BROACH

CROSS-REFERENCE TO RELATED APPLICATIONS

This application claims benefit of U.S. provisional Patent Application Ser. No. 60/536,946, filed Jan. 16, 2004, which is herein incorporated by reference.

BACKGROUND OF THE INVENTION

1. Field of the Invention

Embodiments of the invention generally relate to milling within a wellbore. More particularly, the invention relates to straightening a shifted or restricted wellbore by reciprocating a flexible broach axially within the wellbore.

2. Description of the Related Art

Hydrocarbon wells typically begin by drilling a borehole from the earth's surface to a selected depth in order to intersect a formation. Steel casing lines the borehole formed in the earth during the drilling process. This creates an annular area between the casing and the borehole that is filled with cement to further support and form the wellbore. Thereafter, the borehole is drilled to a greater depth using a smaller diameter drill than the diameter of the surface casing. A liner may be suspended adjacent the lower end of the previously suspended and cemented casing. In general, the diameter, location, and function of the tubular that is placed in the wellbore determines whether it is known as casing, liner, or tubing. However, the general term tubular or tubing encompasses all of the applications.

Shifting of the wellbore caused by pressure changes in the wellbore, swelling of surrounding formations, subsidence, earth movements, and formation changes can deform, bend, partially collapse, or pinch downhole tubulars. Therefore, a cross section of downhole tubulars becomes more irregular and non-round over time. Further, the path through the wellbore may become crooked, offset, or bent at an abrupt angle due to the shifting. Bends in the wellbore and deformed tubulars that define the bore can obstruct passage through the bore of tubing, equipment, and tools used in various exploration and production operations. For example, the bend may prevent a sucker rod from functioning and cause production to cease. Even if the tool can pass through the bore, these obstructions often cause wear and damage to the tubing, equipment, and tools that pass through the obstructed bore.

Current remediation operations to correct bends in the wellbore utilize rotational mills. The rotational mills have cutting surfaces thereon that rotate along the shifted section of the wellbore to remove casing and surrounding materials, thereby reducing the severity or abruptness of the angle. The mill provides a straighter path through the wellbore and reestablishes a bore that a round tubular can pass through. A liner secures in place across the milled portion in order to complete the remediation operation.

However, there exist several problems with using rotational mills for shifted wellbore remediation. In operation, one end of a rigid mill contacts an opposite side of the casing at the shift in the wellbore and places large side loads on the mill along the area being milled. The side loads cause rigid mills to fail prematurely resulting in the expense of replacement and repeated trips downhole to complete the milling process. Further, the mill can sidetrack away from the wellbore if the mill is not kept within the portions of the wellbore on either side of the shifted area during the milling procedure. Recently, rotating mills disposed on flexible members such as cable have been used to initiate the milling process at the shifted portion of the wellbore, thereby permitting a second mill that is run in separately to complete the milling process. Milling by rotation of a flexible mill is described in detail in U.S. Pat. No. 6,155,349, which is hereby incorporated by reference in its entirety. Requiring two trips downhole to complete the milling of the shifted section of the wellbore requires additional time at an added expense. Further, the flexible member may prematurely fatigue due to the stresses caused by the rotation during the milling.

Mills are used in various other wellbore remediation and completion operations. Generally, mills may remove ledges and debris left on the inside diameter of the tubulars such as excess cement, equipment remnants, burrs on the tubular itself, or metal burrs on the inside of the casing around a milled window. Well tubulars may become plugged or coated during production from corrosion products, sediments, hydrocarbon deposits such as paraffin, and scum such as silicates, sulphates, sulphides, carbonates, calcium, and organic growth. Thus, milling operations can remove the debris that collects on the inside surface of the tubular in order to prevent obstruction of the passage of equipment and tools through the bore of the tubulars. Further, mills can be used to elongate windows and straighten the angle into a lateral wellbore.

Therefore, there exists a need for an improved tool and method of milling within a wellbore that reduces stress and fatigue from rotation. There exists a further need for an improved method for remediation of a shifted section of wellbore with a single trip downhole.

SUMMARY OF THE INVENTION

The present invention generally relates to methods and apparatus for milling and/or broaching within a wellbore. A flexible broach runs into the wellbore and is located adjacent a portion of the wellbore to be broached. The broach reciprocates axially within the wellbore and removes at least part of the portion to be broached. Weight may be coupled to the broach, thereby applying a resultant side load for broaching an offset portion of the wellbore. The broach comprises a flexible member that may be a bare cable. When an abrasive material is disposed on an outer surface of the flexible member, the flexible member may be a cable, a continuous rod, or pressurized coiled tubing. Alternatively, sleeves positioned on the flexible member may have an abrasive material on their outer surface. A rotational mill that is either coupled to the broach or run in separately from the broach can further mill the wellbore.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
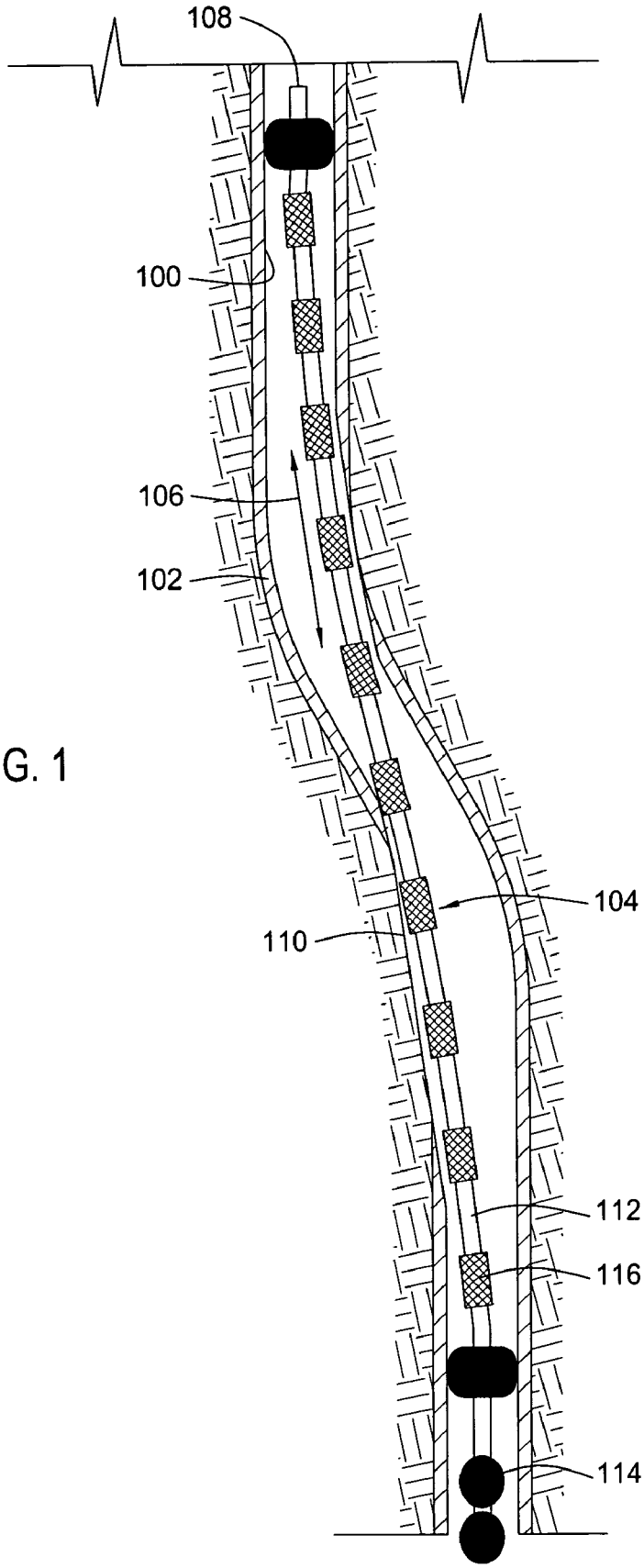
FIG. 1 is a sectional view of a wellbore illustrating a flexible broach reciprocating axially adjacent a shifted or bent section of the wellbore.

The invention generally relates to milling in a wellbore using a flexible broach. FIG. 1 illustrates a wellbore 100 having casing 102 and a flexible broach 104 positioned in the wellbore 100 adjacent a shifted or bent section of the wellbore 100. A downhole camera (not shown) may be run in on the broach 104 or milling tool to establish proper position within the wellbore 100 prior to milling or broaching. Other known locating techniques or devices may be used for locating the broach 104 at the bent section. The broach 104 may be lowered to the bent section using any known conveyance member 108. All of the mills and broaches described herein are run into a wellbore on a conveyance member and located therein. In certain embodiments, the broach 104 may be an integral portion of the conveyance member 108 as will be apparent for embodiments wherein the broach 104 is a cable, a continuous rod, or coiled tubing. As indicated by arrow 106, the broach 104 reciprocates axially within the wellbore 100 to cut or broach a slot 110 in the casing and/or the surrounding formation or cement. The broach 104 may be reciprocated axially by any known method such as by axially moving the conveyance member 108 at the surface of the wellbore 100. In this manner, elimination of rotational torque to the broach 104 prevents fatigue and failure of the broach 104.

The broach 104 shown in FIG. 1 includes a flexible elongated body 112 and a weight 114 attached at a lower end of the elongated flexible body 112. The weight 114 provides tension to the body 112 such that the body 112 frictionally contacts the bent section of the wellbore 100 where the slot 110 is formed. In one embodiment, the body 112 is a bare cable or wire rope that abrades or saws the slot 110 as the broach 104 reciprocates within the wellbore 100. In an alternative embodiment, the body 112 is a cable, a portion of a continuous rod, or a portion of pressurized coiled tubing that is coated with an abrasive material 116 such as crushed tungsten carbide. The abrasive material 116 is shown spaced axially along the body 112. However, the abrasive material 116 may be disposed along the entire length of the body 112. The broach 104 permits cutting of the slot 110 at a high rate since the entire length of the broach 104 cuts the slot 110 using multiple blades formed by the abrasive material 116.

With the broach 104 shown in FIG. 1, it may be necessary to remove the broach from the wellbore 100 and further mill the slot 110 using a rotational mill (not shown) in order to open up the slot 110 to full gage. However, the slot 110 effectively reduces the angle of the bend, the amount of rotational milling required and the stress on the rotational mill. An exemplary rotational mill is illustrated by a rotational milling portion 201 of a milling tool 200 shown in FIG. 2. However, any known rotational mill may be run into the wellbore 100 to open up the slot 110. As explained with the milling tool 200 in FIG. 2, the rotational mill may include a stinger section that guides the rotational mill into the slot 110.

Figure 2:
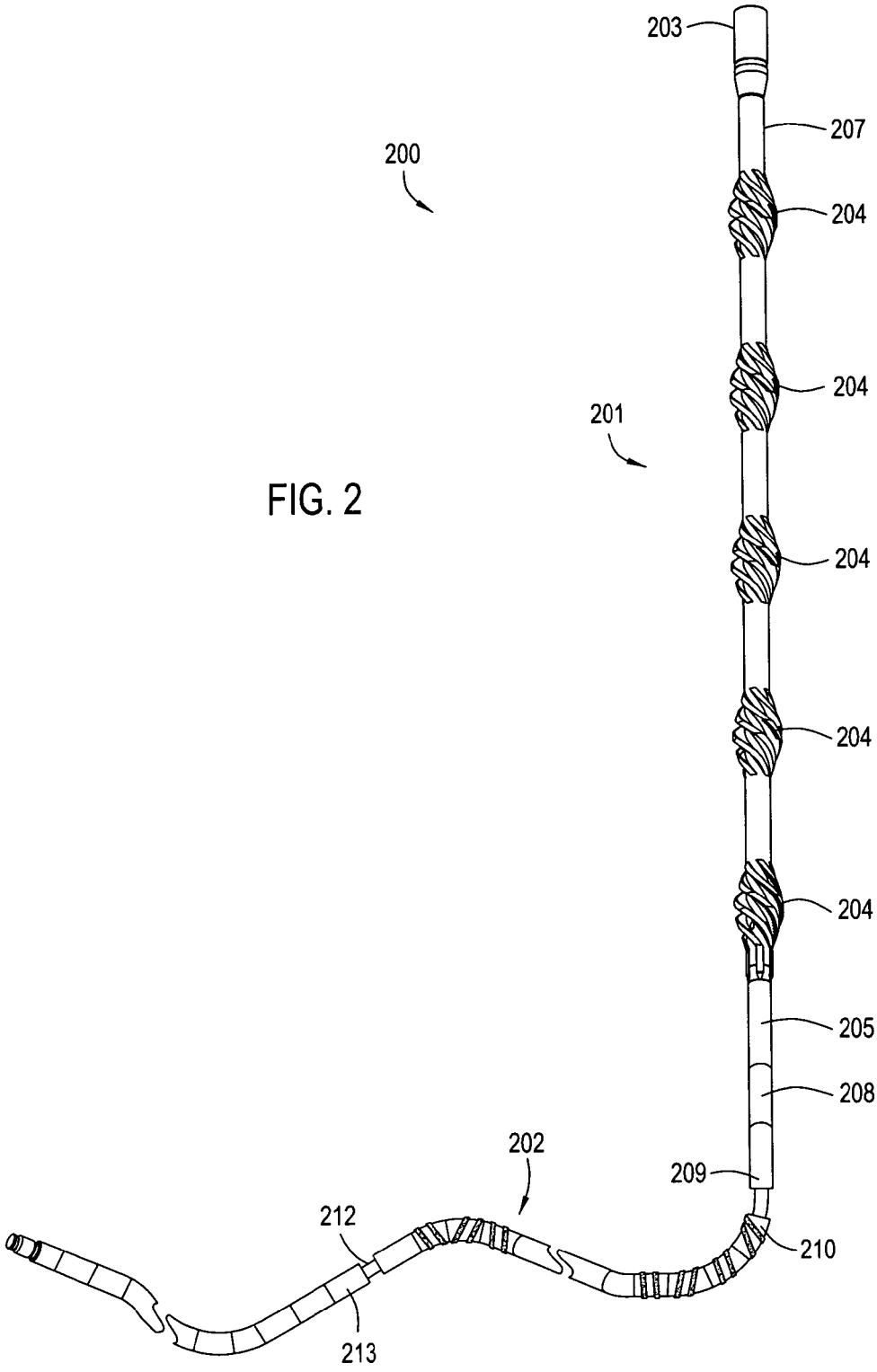
FIG. 2 is a view of a milling tool having a flexible broach portion coupled to a rotational mill portion.

FIG. 2 shows a milling tool 200 having a flexible broach portion 202 coupled to a rotational mill portion 201. The rotational mill portion 201 has a connector end such as box end 203 for connecting to a conveyance member and a stinger 205 opposite the box end 203. Since the stinger 205 is integral with a shaft 207 of the rotational mill portion 201, the rotational mill portion is long, preferably approximately twenty five feet. The length of the rotational mill portion 201 permits the rotational mill portion to flex, thereby aiding in relieving stress. Further, the length of the rotational mill portion 201 initially spaces the box end 203 from the sharp bend in the wellbore in order to prevent the connection at the box end 203 from breaking or failing. The stinger 205 preferably increases in outer diameter towards the box end 203. As shown, the rotational mill portion 201 has five blade sections 204 axially spaced and located between the box end 203 and the stinger 205. However, the rotational mill portion may include any number of blade sections 204. Each blade section 204 has milling inserts (not shown) positioned along the blades directed to cut both down and sideways such that the rotational mill portion 201 relieves some of the side load by milling sideways as well as down.

Between the rotational mill portion 201 and the flexible broach portion 202 is a swivel 208 or knuckle joint that isolates rotational torque applied to the rotational mill portion 201 from the flexible broach portion 202. Additionally, a cable connector such as a cable slip 209 may be used to couple a cable 212 (e.g., a left-hand wound cable) of the flexible broach portion 202 to the rotational mill portion 201. In some embodiments, the cable 212 is fixed to a box connection or other connection in order to couple the cable 212 to the rotational mill portion 201 and does not require use of the cable slip 209.

Figure 3:
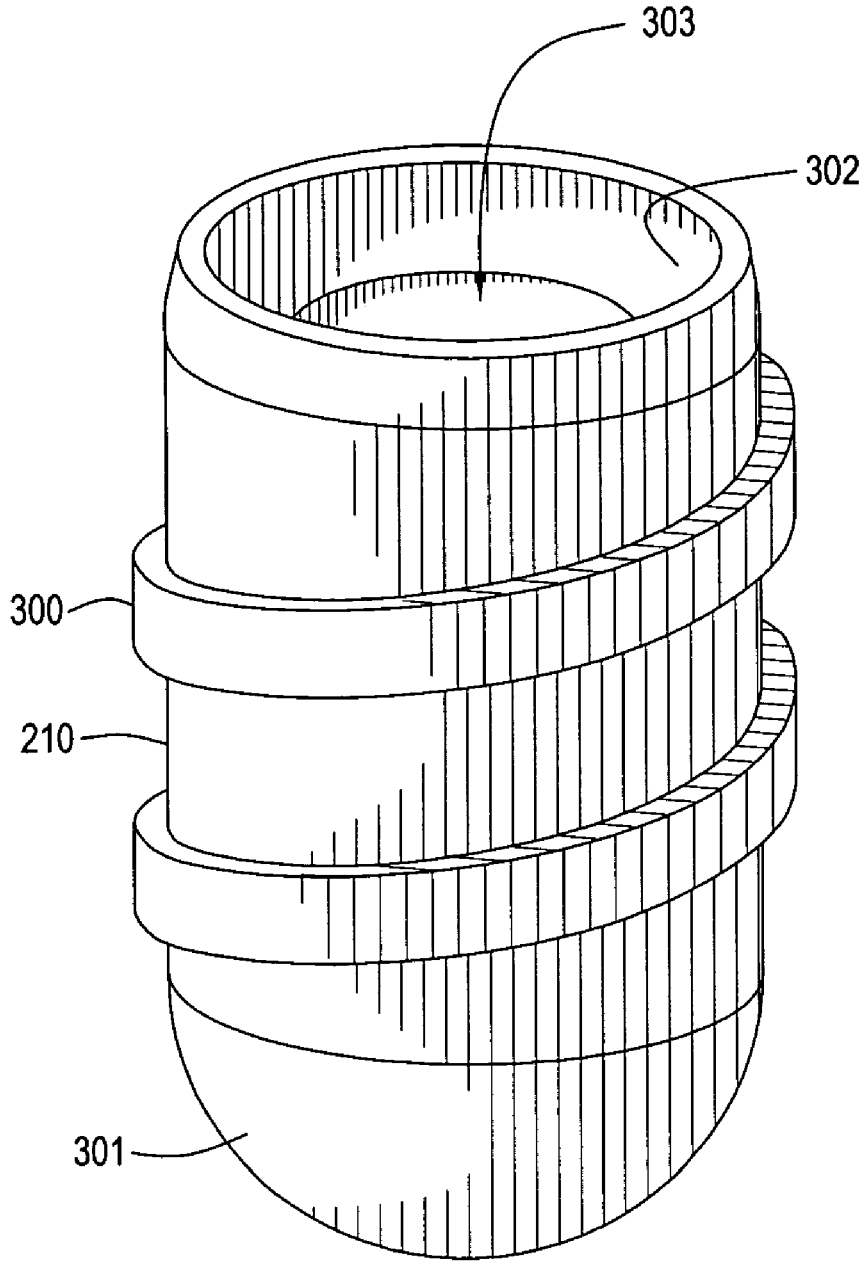
FIG. 3 is a view of a cylinder of the flexible broach portion of the milling tool shown in FIG. 2.

The flexible broach portion 202 includes the cable slipped through an internal longitudinal bore of a series of cylinders 210 coated with an abrasive such as crushed tungsten carbide. As shown in more detail in FIG. 3, each cylinder 210 has the longitudinal bore 303 and a cutting helix 300 on an outside surface that is oriented such that the leading edge of the helix 300 is perpendicular to the area being cut. Thus, helix 300 provides a cutting surface on the cylinder 210 that is perpendicular to the area cut when the cylinder 210 reciprocates axially and not rotationally. The helixes can be offset or at alternating angles (e.g., clockwise and counter clockwise). A convex ball nose 301 of the cylinder 210 mates with a concave socket end 302 of an adjacent cylinder. The ball 301 and socket 302 mating of adjacent cylinders provides flexibility to the flexible broach portion 202. Referring back to FIG. 2, weights 213 are attached to the cable 212 below the cylinders 210 in order to supply tension to the flexible broach portion 202 during a broaching operation. Weights 213 and cylinders 210 may be attached together using tool joints that are babbitted to the cable ends. For example, connections such as between the cable 212 and the rotational mill portion 201 may be formed by positioning a tool joint over an end of the cable 212, fraying the end of the cable and pouring a babbitt or epoxy resin into a socket of the tool joint as is known in the industry.

Figure 4:
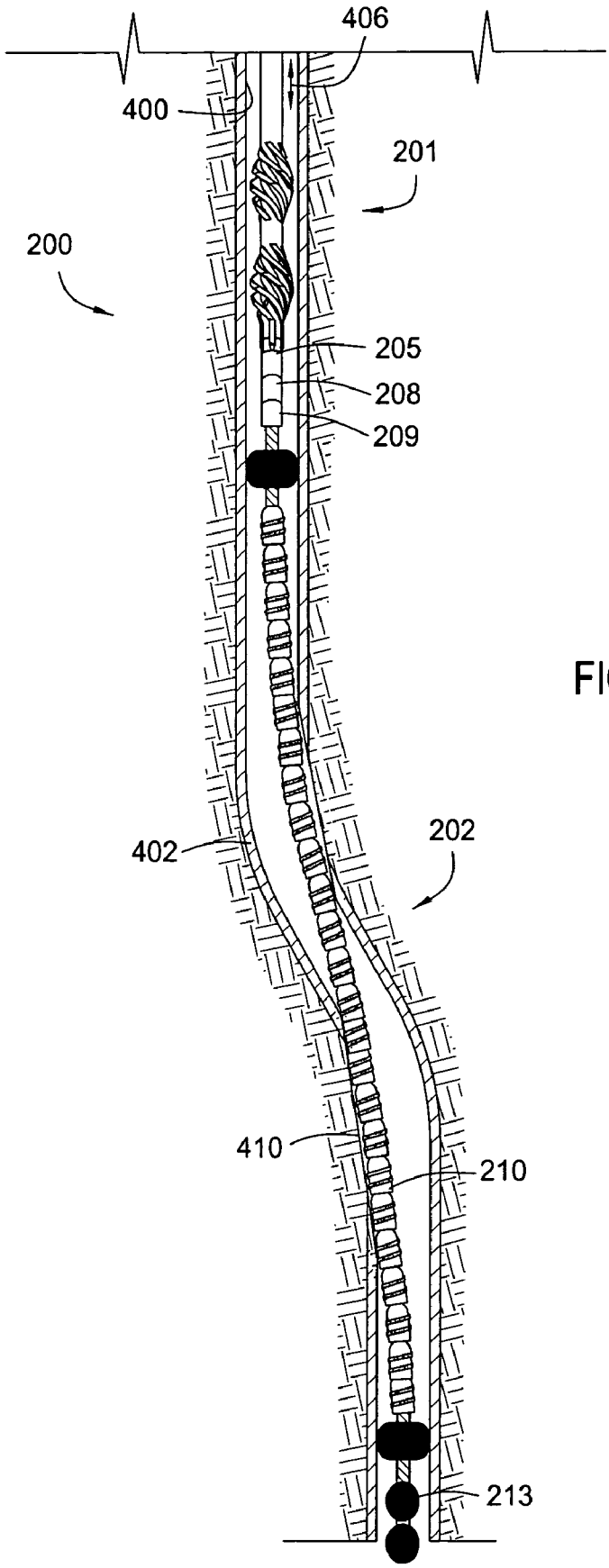
FIG. 4 is a view of the milling tool shown in FIG. 2 during a broaching operation within a wellbore.

FIG. 4 shows the milling tool 200 shown in FIG. 2 during a broaching operation within a wellbore 400. As indicated by arrow 406, the milling tool 200 reciprocates axially to cut a slot 410 into a casing 402 at a bend in the wellbore 400. During the broaching operation, the flexible broaching portion 202 is located adjacent the bend in the wellbore 400. Thus, the reciprocation of the cylinders 210 having abrasive outer surfaces in contact with the casing 402 at the bend broaches the slot 410.

Figure 5:
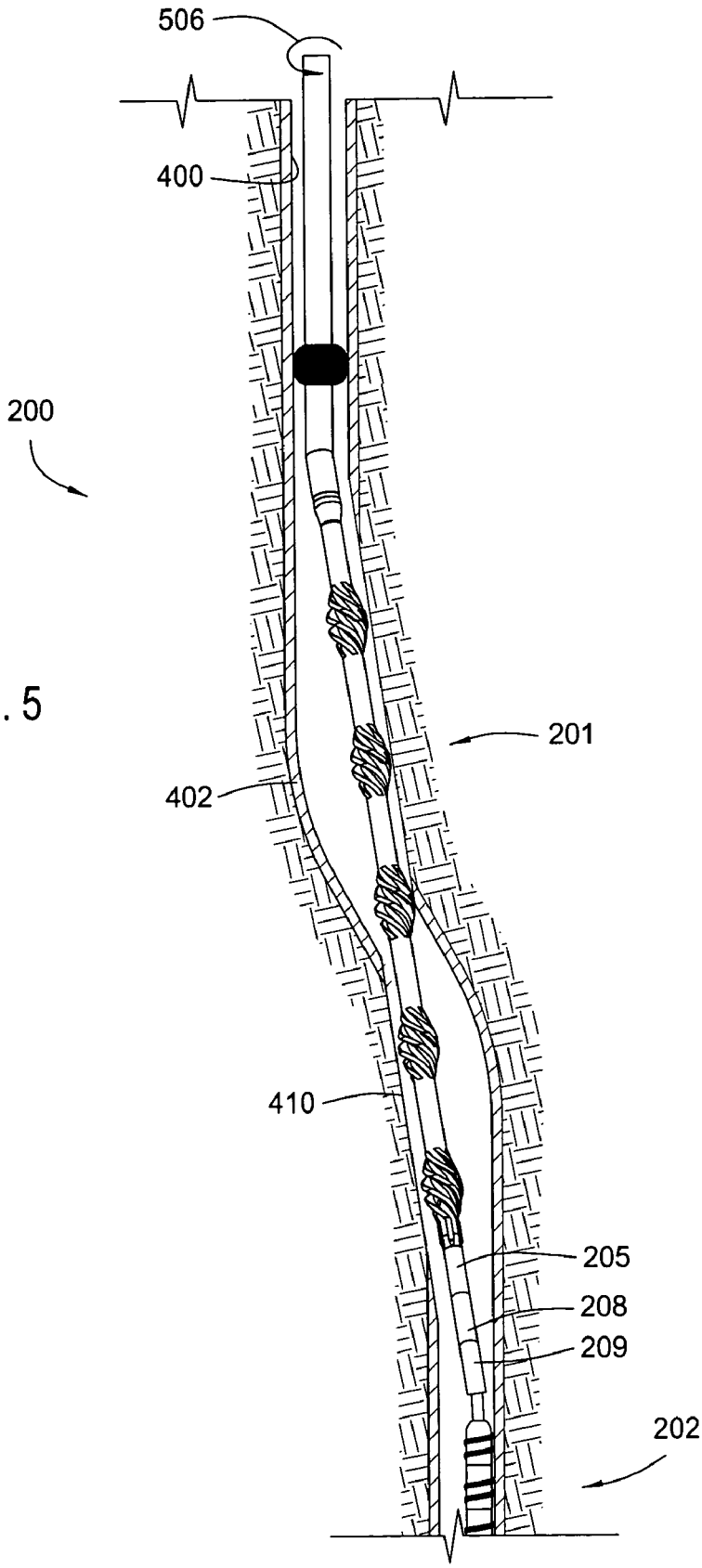
FIG. 5 is a view of the milling tool shown in FIG. 2 during a milling operation within the wellbore.

FIG. 5 illustrates the milling tool 200 during a milling operation after forming the slot 410 in the casing 402 with the broaching operation. The stinger 205 enters the slot formed by the flexible broach portion 202 to guide the rotational mill portion 201 during the milling operation. Further, the stinger deflects in order to provide a side force so that the rotational mill portion 201 located adjacent the bend mills sideways to relieve its own stress. As indicated by arrow 506, the milling tool 200 rotates to mill the wellbore 400 at the bend using the rotational mill portion 201. The swivel 208 prevents transferring rotation to the flexible broach portion 202. Even if rotation is transferred to the flexible broach portion 202, the flexible broach portion 202 is not stressed during the rotation from the milling operation.

Any flexible broach 104 embodiment described in FIG. 1 may replace the flexible broach portion 202 of the milling tool 200 shown in FIG. 2. Further, while FIGS. 2, 4 and 5 are shown having the rotational mill portion 201 coupled to the flexible broach portion 202, the flexible broach portion 202 may be used independently of the rotational mill portion 201 in a manner similar to the flexible broach 104 shown in FIG. 1. In this instance, it may be necessary to have cylinders 210 that increase in outer diameter toward the surface of the wellbore. The cylinders 210 with a smaller diameter can enter a deformed portion of the casing that would not permit passage of the cylinders having a larger diameter. Once the smaller diameter cylinders broach the wellbore, the larger diameter cylinders can be lowered to broach the wellbore to full gage.

Figure 6:
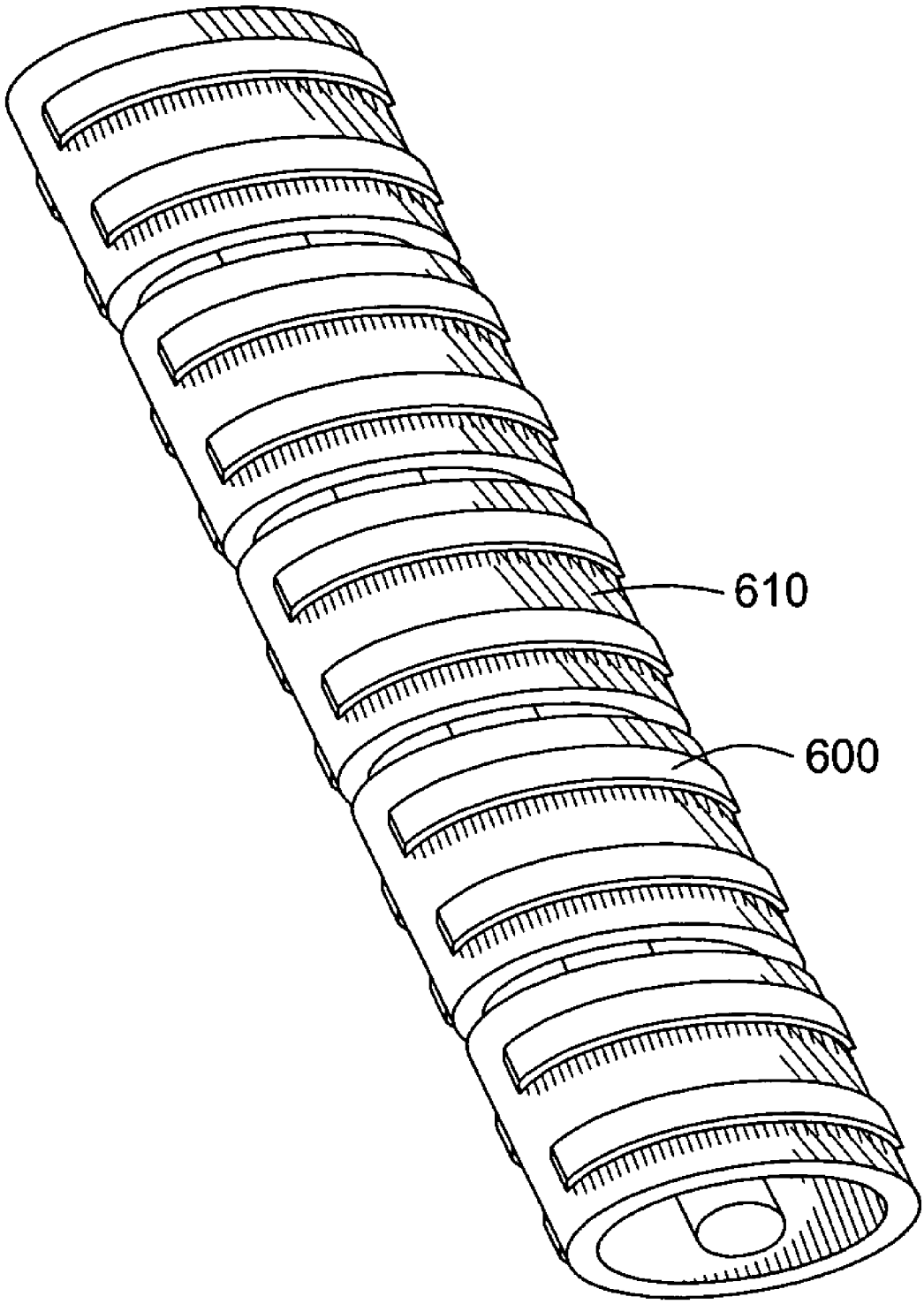
FIG. 6 is a view of an elliptical cylinder for coupling to adjacent elliptical cylinders to form a flexible broaching tool.

FIG. 6 illustrates an elliptical cylinder 610 with an abrasive material such as crushed tungsten carbide 600 on an outside surface thereof. The elliptical cylinder 610 slips onto a cable next to adjacent elliptical cylinders to form a flexible broaching tool similar to the flexible broach portion 202 shown in FIG. 2. The elliptical cylinder 610 has a major axis that orients within casing that has been deformed by a shifted wellbore to also have a major axis. In this manner, the elliptical cylinder 610 orients in a predetermined direction and the major axis is large enough to create a full gage slot by broaching as described herein.

While the foregoing is directed to embodiments of the invention, other and further embodiments of the invention may be devised without departing from the basic scope thereof, and the scope thereof is determined by the claims that follow.

The invention claimed is:

1. A method for broaching a wellbore, comprising:

positioning a flexible broach in the wellbore adjacent a portion of the wellbore to be broached;

reciprocating the broach axially within the wellbore to remove at least part of the portion of the wellbore to be broached; and isolating the flexible broach from the rotation of one or more downhole tools using a swivel.

2. The method of claim 1, further comprising applying a side load to the broach, the side load providing frictional contact between a portion of the broach and the portion of the wellbore to be broached.

3. The method of claim 1, wherein the broach comprises a cable.

4. The method of claim 1, wherein the broach comprises a cable having an abrasive material disposed on an outer surface thereof.

5. The method of claim 1, wherein the broach comprises a continuous rod having an abrasive material disposed on an outer surface thereof.

6. The method of claim 1, wherein the broach comprises pressurized coiled tubing having an abrasive material disposed on an outer surface thereof, the tubing being pressurized to affect its stiffness.

7. The method of claim 1, wherein the broach comprises a series of sleeves surrounding a flexible member, the sleeves having an abrasive material on an outer surface thereof.

8. The method of claim 7, wherein each sleeve is a cylinder shape having a convex end that mates with a concave end of an adjacent sleeve.

9. The method of claim 7, wherein the sleeve has an elliptical shape.

10. The method of claim 1, further comprising forming a slot in the wellbore by reciprocating the broach.

11. The method of claim 10, further comprising guiding a stinger into the slot of the wellbore.

12. The method of claim 11, further comprising guiding a rotational milling tool using the stinger and the slot.

13. The method of claim 12, further comprising milling the offset by rotating the milling tool operatively coupled to the flexible broach.

14. The method of claim 13, further comprising maintaining the flexible broach substantially rotationally stationary during rotating of the milling tool.

15. A method for milling an offset in a wellbore, comprising:

positioning a flexible broach portion of a milling tool in the wellbore adjacent the offset;

moving the broach portion axially within the wellbore to remove at least part of the offset;

positioning a rotational mill portion of the milling tool adjacent the offset; and rotating the rotational mill portion to remove at least part of the offset.

16. The method of claim 15, wherein moving the broach portion comprises reciprocating.

17. The method of claim 15, wherein the broach portion is substantially rotationally stationary during rotating of the mill portion.

18. The method of claim 15, wherein rotating the rotational mill occurs after moving the broach portion axially.

19. The method of claim 15, wherein a coupling member is provided between the flexible broach portion and the rotational mill portion for coupling the flexible broach portion to the rotational mill portion.

20. The method of claim 19, wherein the coupling member is a swivel.

21. The method of claim 15, further comprising forming a slot by moving the broach portion axially.

22. The method of claim 21, further comprising guiding a stinger on the mill portion of the milling tool into the slot.

23. The method of claim 15, further comprising isolating the rotation of the rotational mill from the broach portion using a swivel.

24. The method of claim 15, wherein the rotational mill portion comprises a plurality of blade sections coupled to a tubular and the milling tool comprises a plurality of cylinders having flexibly coupled to one another and having a cutting surface on an outer face of the cylinders.

25. A broach for use in a wellbore, comprising:

a flexible main body;

a series of sleeves coupled to the main body, wherein each sleeve has a major and a minor axis and an abrasive material disposed on an outside surface thereof, wherein each sleeve has a convex end that mates with a concave end of an adjacent sleeve; and a rotation isolation member configured to couple the flexible main body to one or more downhole tools.

26. The broach of claim 25, wherein each sleeve is in the shape of an ellipse.

27. The broach of claim 25, wherein the flexible main body is a cable run through a central aperture of each sleeve.

28. The broach of claim 25, further comprising a weight coupled to the flexible main body.

29. A milling tool for use in a wellbore, comprising:

a rotational mill portion;

a flexible broach portion coupled to the rotational mill portion; and a rotational isolation member configured to operatively couple the broach portion to the rotational mill portion.

30. The milling tool of claim 29, wherein the rotation isolation member is a swivel disposed between the broach portion and the mill portion that substantially prevents rotation of the broach portion.

31. The milling tool of claim 29, further comprising a weight coupled to the flexible broach portion.

32. The milling tool of claim 29, further comprising a weight coupled to the flexible broach portion, wherein the weight is flexible.

33. The milling tool of claim 29, further comprising a stinger on the rotational mill portion of the milling tool configured to enter a slot in an offset formed by reciprocation of the flexible reciprocating broaching portion and to guide the rotational mill portion during milling.

34. A milling tool for milling an offset in a wellbore, comprising:

a flexible broach portion configured to be moved into a position in the wellbore adjacent the offset and adapted to be reciprocated axially within the wellbore to remove at least a part of the offset and form a slot therein; and a rotational mill portion coupled to the broach portion, arranged to be moved into a position in the wellbore adjacent the offset subsequent to the reciprocation of the broach portion and adapted to be rotated to remove at least a further part of the slot.

35. The milling tool of claim 34, further comprising a stinger configured to guide into the slot and thereby guide the rotational mill portion into position proximate the slot.

36. The milling tool of claim 34, further comprising a rotation isolation member disposed between the flexible broach portion and the rotational mill portion that substantially prevents rotation of the flexible broach portion.

* * * * *